US005245130A

United States Patent [19]

Wheaton

[11] Patent Number: 5,245,130

[45] Date of Patent: Sep. 14, 1993

[54] POLYPHONIC BREATH CONTROLLED ELECTRONIC MUSICAL INSTRUMENT

[75] Inventor: James A. Wheaton, Fairfax, Calif.

[73] Assignee: Yamaha Corporation, Hamamatsu, Japan

[21] Appl. No.: 656,781

[22] Filed: Feb. 15, 1991

[51] Int. Cl.[5] ..... G10H 3/12; G10H 1/18

[52] U.S. Cl. ..... 84/742; 84/377; 84/DIG. 14; 84/658

[58] Field of Search ..... 84/DIG. 14, 377, 378, 84/379, 723, 735, 742, 743, 724, 734, 626, 644, 645, 658, 687

[56] References Cited

U.S. PATENT DOCUMENTS

| | | | |
|---|---|---|---|
| 4,252,045 | 2/1981 | Nagura | 84/687 |
| 4,385,541 | 5/1983 | Müller et al. | 84/DIG. 14 |
| 4,566,363 | 1/1986 | Arai . | |
| 4,837,836 | 6/1989 | Barcus | 84/723 |
| 4,984,499 | 1/1991 | Schille | 84/734 |
| 4,993,308 | 2/1991 | Villeneuve | 84/724 |

FOREIGN PATENT DOCUMENTS

| | | |
|---|---|---|
| 62-201794 | 12/1987 | Japan . |
| 63-220292 | 9/1988 | Japan . |

OTHER PUBLICATIONS

"A Miniature Anemometer for Ultrafast Response" Sensors, Dec. 1989, pp. 22–26.

*Primary Examiner*—William M. Shoop, Jr.

*Assistant Examiner*—Jeffrey W. Donels

*Attorney, Agent, or Firm*—Graham & James

[57] ABSTRACT

A polyphonic breath controlled electronic musical instrument includes a hand held breath sensor unit having a plurality of bidirectional air flow sensing passageways for detecting sucking or blowing action of the performer in a manner similar to a conventional acoustic harmonica. The breath sensor unit further includes pressure sensing transducers on the surface thereof, adapted to sense lip pressure and finger pressure of the performer, as well as a plurality of switches activated by the fingers of the performer holding the breath sensor unit. A microphone configured in the breath sensor unit picks up the vocal sounds of the performer. A thumb wheel controller is provided on the sensor unit to allow a control of tone parameters, such as volume, by the thumb of the performer. The signals from the sensors and switches on the sensor unit are provided to a remote electronic control unit which converts the analog sensor signals and on/off switch signals to MIDI control data in response to programs set by the performer. The performer may set various combinations of tone effects which may be varied in the performance by the performer activating the switches and pressure sensors. A tone generator receives the MIDI control signals and provides musical tones in response thereto. A conventional acoustic harmonica may be accurately emulated in addition to providing a number of other digital musical effects.

34 Claims, 5 Drawing Sheets

POLYPHONIC BREATH CONTROLLED ELECTRONIC MUSICAL INSTRUMENT

BACKGROUND OF THE INVENTION

1. Field of the Invention

The present invention relates to electronic musical instruments. More particularly, the present invention relates to breath controlled electronic musical instruments.

2. Description of the Prior Art and Related Information

Electronic musical instruments have been developed which provide excellent simulation of a wide variety of natural musical instruments. The most common approach to controlling generation of such electronically generated musical tones is by way of a conventional keyboard. In addition to the typical musical voices controlled by keyboard, such as a piano, organ, harpsichord, etc., keyboard controlled electronic musical instruments can also generate a wide variety of other musical voices including stringed instruments, percussion instruments, etc. The advantages of keyboard control include familiarity of the keyboard layout, flexibility to provide different types of chords, split keyboard effects and other forms of tone control, as well as individual note generation. Other types of control systems have also been used, including drum pads for generating electronic drum sounds and other percussion sounds, and some breath controllers which simulate wind instruments. Such keyboards, drum pads and breath controllers have generally been relatively restricted in the number of tone patterns that can be generated, and are typically limited to the specific instrument they are designed to emulate.

One natural musical instrument which has not received as significant a degree of emulation in the electronic musical instrument field as other natural musical instruments, is the harmonica. The harmonica has a number of advantages as an electronic musical control device, especially for novice musicians. In particular, the harmonica is a relatively simple instrument for most performers to learn to play and provides the ability to sound individual notes as well as chords. Nonetheless, the use of a suitable breath controller configured similarly to a harmonica has not been developed which can achieve the desired flexibility and compatibility with electronic musical instrument tone generation systems.

Examples of prior approaches to developing an electronic musical instrument employing a harmonica-like breath controller are disclosed in U.S. Pat. No. 4,619,175 to Matsuzaki, issued Oct. 28, 1986, and U.S. Pat. No. 4,566,363 to Arai, issued Jan. 28, 1986. Although these patents are directed to providing an electronic musical instrument control device modelled after a harmonica, they suffer from a number of disadvantages and fail to fully exploit the potentials of a breath controlled electronic musical instrument. Furthermore, such patents do not provide a breath controlled electronic musical instrument capable of fully simulating the effect of a harmonica in a performance environment.

More particularly, the aforementioned prior art electronic musical instruments employing harmonica type controllers require separate through holes, or apertures, to detect the sucking and blowing action of the performer of the instrument, respectively. This results in an unfamiliar breath hole layout (or spacing) for the performer as compared to a conventional harmonica. Due to the importance of slight variations of breath into the holes, this difference in the breath hole layout renders the breath control different from a natural harmonica. Also, the breath controllers disclosed in the aforementioned patents do not provide a system capable of rendering a live harmonica performance sound. For example, a typical live performance of a harmonica will employ a standard hand held acoustic harmonica and a microphone held by the performer adjacent the outlet holes of the harmonica to pick up and amplify the sound. Thus, the sound which is amplified includes not only the harmonica sounds but related sounds generated by the blowing action, as well as any related sound effects generated by the performer. In the aforementioned breath controlled electronic musical instruments, the tone of the harmonica is amplified from signals in the airflow apertures which are responsive only to the air flow pressure and produce only a corresponding harmonica tone. Thus, the related sound effects provided by the performer in a live performance are omitted from the electronic musical instrument, and thus an unrealistic effect is the ultimate result.

Additionally, the above-noted prior art harmonica-like breath controllers fail to exploit the potential flexibility of an electronic musical instrument which enables the performer to control the instrument in a natural way. In particular, the '363 patent attempts to provide additional flexibility in tone generation by including a keyboard on the top of the harmonica-like breath controller unit. However, such a keyboard cannot be activated while the performer holds the harmonica-like controller unit in a natural manner adjacent his mouth. As a result, the keyboard is operated separately and independently from a harmonica-like mouth activated mode in response to a mode setting switch. Therefore, for a given performance, little flexibility is added over a conventional acoustic harmonica despite the potential capability of an electronic musical instrument tone generation system.

For the foregoing reasons, a need presently exists for a breath controlled electronic musical instrument which is capable of providing a natural sounding harmonica performance, as well as providing flexibility for additional electronic musical instrument based sounds and tones, which may be readily controlled by a performer during a performance.

SUMMARY OF THE INVENTION

The present invention provides a breath controlled electronic musical instrument adapted to recreate the performance characteristics of an acoustic harmonica, as well as provide flexibility for additional performance variations and tones not provided by a conventional harmonica.

The present invention provides an electronic musical instrument having a hand held breath controller unit, an electronics unit coupled to the breath controller unit for converting the breath controller output to standardized MIDI (Musical Instrument Digital Interface) control signals, and an audio generation subsystem responsive to the MIDI control signals.

The breath controller unit employs a plurality of air flow passageways configured similarly to a conventional harmonica. Each of the air flow passageways includes bidirectional air flow sensors, preferably in the form of thin solid state air flow transducers mounted on directional air flow baffles. This enables inhaling and exhaling to be separately detected in a single passageway, while maintaining the layout and breath response of a conventional harmonica. In addition, in a preferred embodiment, the breath controller unit employs a microphone, a plurality of control transducers, and a plurality of switches configured in a position adapted to be activated by the performer's fingers. The microphone detects the sounds of the performer, for example, humming or other background noises, which are typical during a harmonica performance. The control transducers are adapted to detect lip pressure and finger pressure applied by the performer while blowing into the breath controller unit. A force sensing resistive film may be employed for both the lip pressure detection and the finger pressure detection transducers. Additionally, a control transducer in the form of a control wheel, for example, is provided on the breath controller unit conveniently next to the performer's thumb for variable control such as volume control over the tone output. The switches are used to activate/deactivate the microphone, or one or more of the tone control transducers, as well as provide various pitch or tone modification functions during a performance.

The electronics unit, coupled to the breath controller unit through wires or an RF link, receives the various control signals output by the breath controller unit and provides tone pitch and volume output signals, preferably in digital MIDI format, as well as various additional MIDI digital effect control signals. Air flow signals from the bidirectional sensors in each of the air flow passageways are first compared to discriminate the air flow direction, compared to a threshold level, and then mapped onto a predetermined pitch. The performer, by blowing or sucking air through the air flow passageways, can then select tone pitch in a manner similar to a conventional harmonica. This assignment of passageways to pitch is stored in a memory having a plurality of such assignments stored therein. By activating a switch on the electronics unit, or one of the switches on the breath controller unit, this mapping assignment may be changed either at the onset of a performance or during the performance. The pitch mapping may also be smoothly varied by continuous control of one of the control transducers mounted on the breath control unit to create, for example, a pitch bend effect. The other control transducers control additional special effects, which specific effects to be controlled are set by the electronics unit. For example, reverberation effects, varying tone colors, chord effects, etc., may be controlled at the onset of, or during, a performance.

The tone control signals resulting from the processing of the tone signals from the breath controller unit, in the form of MIDI signals, are provided to an audio generation subsystem employing conventional components adapted to receive MIDI control signals and generate audible musical tones.

From the foregoing, it will be appreciated that the present invention provides a breath controlled electronic musical instrument having the capability of providing realistic harmonica performance effects, as well as the flexibility to provide additional tone colors, tone voices and various digital effects not available with a conventional acoustic harmonica. Furthermore, the breath controller unit may be operated in a convenient manner by the performer.

BRIEF DESCRIPTION OF THE DRAWINGS

FIG. 3(*b*) is a cross-sectional view of an air flow passageway in the breath controller unit of the present invention.

DETAILED DESCRIPTION OF THE INVENTION

Figure 1:
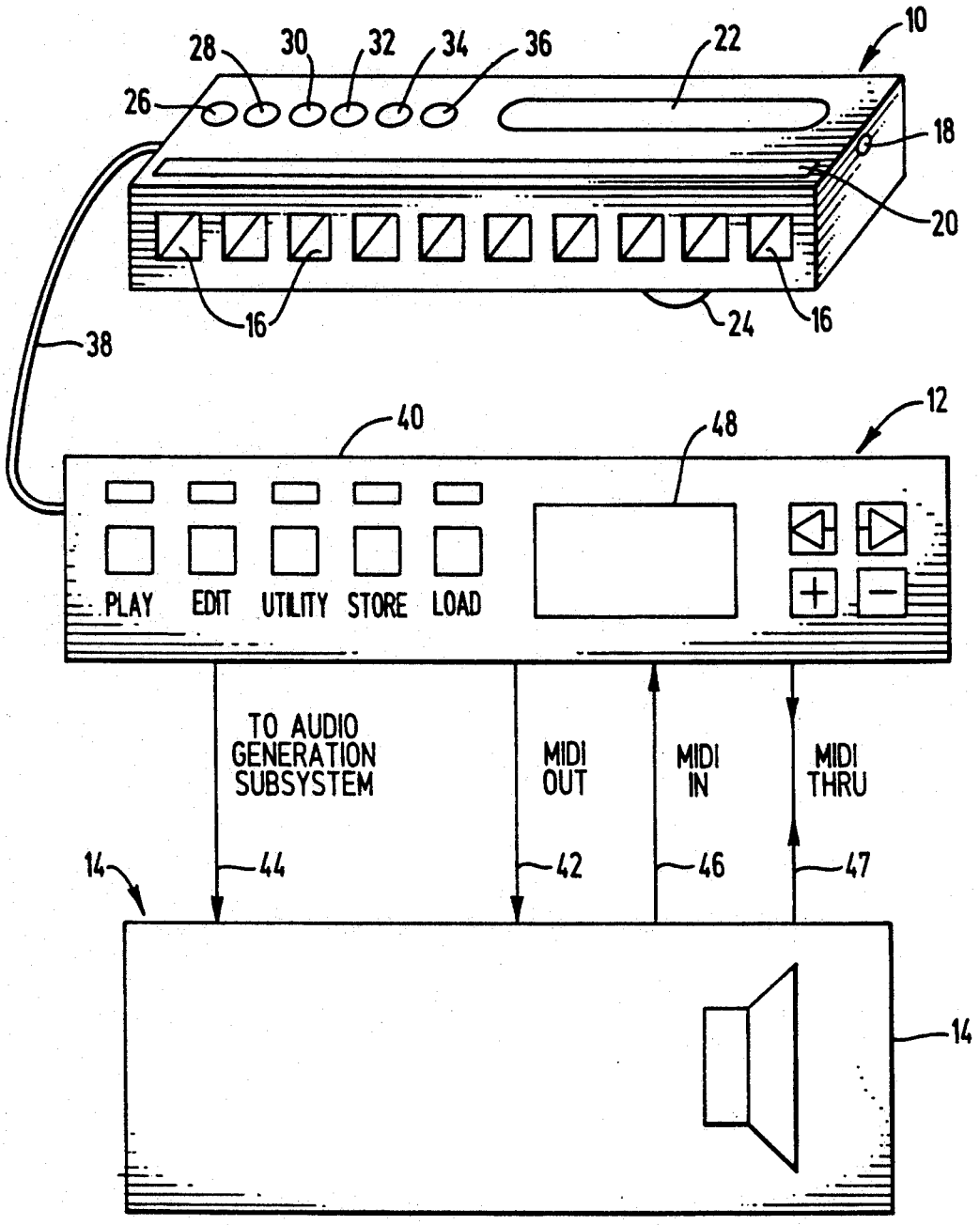
FIG. 1 is a schematic/perspective view of the breath controlled electronic musical instrument of the present invention.

Referring to FIG. 1, a preferred embodiment of the breath controlled electronic musical instrument of the present invention is illustrated in a perspective/-schematic view. As shown in FIG. 1, the electronic musical instrument of the present invention includes a breath controller unit 10, an electronics unit 12 and an audio generation subsystem 14.

Breath controller unit 10 is preferably adapted to be held in a performer's hand and is thus of a size similar to a conventional harmonica, or other convenient size which can be held by a performer. The breath controller unit 10 includes a plurality of air flow passageways 16 configured to receive air from the performer in response to sucking or blowing actions, in a manner similar to a conventional harmonica performance. In FIG. 1, ten air flow passageways 16 are illustrated. It will be appreciated, however, that a greater or lesser number of air flow passageways may be provided, as determined by the specific size of breath controller unit 10 and/or the amount of note information desired to be provided. The structure of air flow passageways 16, as well as the nature of the air flow sensors disposed therein are discussed in more detail below in relation to FIGS. 2 and 3.

As further shown in FIG. 1, breath controller unit 10 also includes a microphone 18, mounted directly in the breath controller unit 10. Although microphone 18 is illustrated as being configured in one side of breath controller unit 10, any other convenient location for microphone 18 may also be employed, so as to detect the sounds made by the performer during a performance, such as humming, singing, etc. Although only one microphone 18 is illustrated, more than one microphone may be employed, and these may be located about the side, top and/or front of the breath control unit 10, so as to ensure accurate pickup of the performer's sounds during a harmonica like performance.

Breath controller unit 10 further includes a lip pressure control transducer 20. The lip pressure control transducer 20 is configured so as to sense the pressure applied to the breath controller unit 10 by the lip of the performer while blowing/sucking into the unit in a natural manner. A matching lip pressure control transducer (not shown) is located on the bottom of the breath controller unit 10. Lip pressure transducer 20 preferably employs a force sensing resistive film. Suitable force sensing resistive films are commercially available, for example, from Interlink Electronics, Inc., Santa Barbara, Calif. The thick film nature of such force sensing resistors provides for convenient sensing of the pressure applied by the lip of the performer. Other types of pressure sensing transducers may be employed in place of force sensing resistor film 20, however, for example, conductive rubber.

Breath controller unit 10 further includes a finger pressure sensing control transducer 22. The finger pressure transducer 22 is configured so as to receive the performer's fingers of one hand when holding the breath controller unit in a natural manner. Finger pressure transducer 22 is preferably a force sensing resistor thick film of the same type as employed for lip pressure control transducer 20. The force supplied by the fingers is detected by the force sensing resistor film and output as a control signal. Although the finger pressure transducer 22 is illustrated as a single extended force sensing resistor film in FIG. 1, it will be appreciated that it may be separated into several discrete portions adapted to receive the individual fingers of the performers hand. Also, other pressure sensing transducers may be employed to sense finger pressure from the performer's other hand, in addition to the force sensing resistor film generally illustrated in FIG. 1.

As further illustrated in FIG. 1, the breath controller unit 10 includes a thumb wheel controller 24 situated on the bottom of breath controller unit 10. Thumb wheel controller 24 is situated so as to be conveniently located near the thumb of the performer when the performer holds the breath controller in a manner similar to a harmonica. The thumb wheel controller 24 enables a varying output signal to be produced by rotation of the thumb wheel. It will be appreciated however, that other types of transducers adapted to be adjusted by the thumb of a performer may also be employed.

As further shown in FIG. 1, breath controller unit 10 preferably includes switches 26, 28, 30, 32, 34 and 36 configured on the upper surface of breath controller unit 10. Switches 26–34 may preferably be single pole momentary switches which can be readily activated by the left hand of the performer holding the breath controller unit 10. Although the position of the switches illustrated is presently preferred, it will of course be appreciated that various other types of on/off switches may also be employed and may be situated at other locations on the breath controller unit 10. Also, the configuration of the switches may be altered for left handed performers, or for other specific needs of the performer.

The various control transducers, switches, microphone and air flow sensor units on the breath controller unit 10 provide a variety of output signals which are all routed through to electronics control unit 12 via output cable 38. The manner in which the variety of control signals may be used to control musical tone generation in a varied manner, will be discussed below.

As illustrated in FIG. 1, the electronics control unit 12 may preferably be separate from the breath controller unit 10 to allow the breath controller unit 10 to be a compact hand held unit. The electronics control unit 12 is electrically coupled to the breath controller unit 10 through data cable 38 and may be mounted in a separate control unit or may be adapted to be attached to the performer's belt. In the latter case, the number of functions available to the control unit 12 may be somewhat reduced, however. Also, data cable 38 may be replaced by an RF link, facilitating even greater freedom of movement to the player using the breath controller unit 10.

As illustrated in FIG. 1, the electronics control unit 12 will preferably include a front control panel 40. Control panel 40 allows the performer to provide programming and/or other information to the electronics unit 12 to control the programming and operation of the switches and sensors on breath controller unit 10 and to control the processing of the output signals from controller unit 10. In a preferred embodiment discussed below in relation to FIG. 4, electronics unit 12 receives the analog air flow sensor signals and other analog control signals provided along data cable 38 and produces an output in the form of a digital Musical Instrument Digital Interface (MIDI) signal along line 42. Also, as indicated in FIG. 1, a separate analog output may be provided along line 44, corresponding to the output of microphone 18. Additionally, the electronics control unit 12 may receive MIDI feedback information from the audio generation subsystem 14 along line 46. As further illustrated in FIG. 1, the electronics unit 12 will preferably include a display panel 48 which displays the functional status of the unit. The display panel 48 may be, for example, a LCD or other well known form of display, with the output thereof controlled by the electronics control unit 12.

As shown in FIG. 1, the audio generation subsystem 14 receives the MIDI signal from control unit 12 on line 42 and the analog microphone signal on line 44 and generates musical tones under the control of these signals. As will be described in more detail below in relation to FIG. 5, the audio generation subsystem 14 may be comprised of commonly available modular tone generation components and audio amplification components due to the standardized nature of the MIDI control signal provided along line 42 and the analog signal on line 44. Also, audio generation subsystem 14 may include one or more digital effects units which may be controlled by the MIDI control signal along line 42; for example, to add reverberation to the final audio signal.

Figure 2:
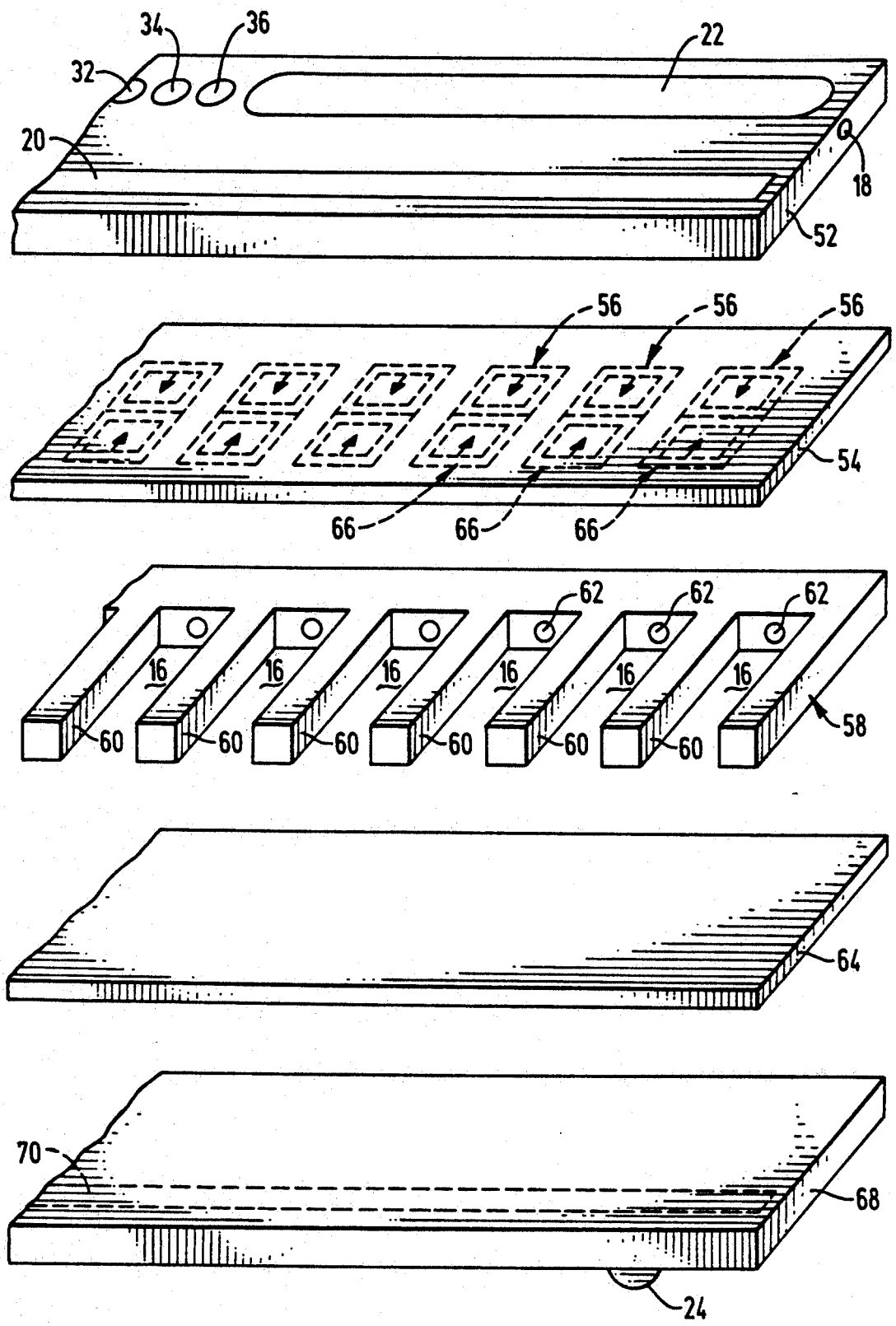
FIG. 2 is an exploded view of the breath controller unit of the present invention.

Referring to FIG. 2, a preferred embodiment of the breath controller unit 10 is illustrated in an exploded view. For convenience of illustration, only a portion of the total breath control unit 10 is illustrated, showing six breath air flow holes 16, as opposed to preferred embodiment of ten as illustrated in FIG. 1. As shown in FIG. 2, in a preferred embodiment, breath controller unit 10 has a "sandwich" structure. The sandwich structure of the breath controller unit 10 includes a top section 52 having force sensing resistive films 20 and 22, as well as switches 26–36 on the top surface and microphone 18 mounted on the side thereof. The pick up leads for the force sensitive resistive films 20, 22, as well as the electrical connections to the switches and air flow sensors, are preferably integrally formed into a thin printed circuit board formed on the bottom of the top section 52.

The sandwich structure of the breath controller unit 10 further includes a top air flow sensor plate 54 having a number of directional air flow sensors 56, 66, respectively, mounted thereon. In a preferred embodiment, two air flow sensors 56, 66 are provided for each passageway 16. The air flow sensors 56 are mounted on the bottom portion of the top air flow plate 54 so as to sense air flow through the passage therebelow through passageways 16. Air flow sensors 56, 66 are preferably solid state air flow transducers which may, for example, be of the type described by Henderson, et al., in *Sensor*, Dec. 22, 1989, the disclosure of which is herein incorporated by reference. As illustrated schematically in FIG. 2, and in more detail in FIGS. 3(*a*) and 3(*b*), these solid state air flow transducers are thin semiconductor devices which may be readily incorporated in a compact breath controller unit. As indicated by the arrow on each of the air flow sensors 56, 66 and as described in more detail in relation to FIGS. 3(*a*) and 3(*b*), the sensors 56, 66 are preferably directionally sensitive and detect only air flow in the direction of the arrow which, in this instance, corresponds to a blowing action of the performer. In a preferred embodiment, this directional sensitivity is achieved by mounting the sensors 56, 66 on directional air flow baffles, illustrated in FIGS. 3(*a*) and 3(*b*). Air flow sensor output signals are preferably provided along conductive traces (not shown) which may be formed on top air flow sensor plate 54, using well known printed circuit techniques.

Still referring to FIG. 2, a middle air flow sensor section 58 of the breath controller unit 10 has a partitioned "comb-like" structure defining air flow passageways 16 by a series of vertical partitions 60. At the end of each passageway 16 is an air flow hole 62 having a diameter chosen to provide a desired air flow velocity through passageway 16 for a given blowing or sucking pressure. The air flow holes 62 extend through to the back of middle section 58 to allow the air and any saliva to leave the breath controller unit 10. Configured to secure to the bottom of the middle air flow sensor section 58 of the breath controller unit sandwich structure is a bottom air flow sensor plate 64. It will thus be appreciated that the top air flow sensor plate 54, middle air flow sensor plate 58 and bottom air flow sensor plate 64 together define air flow passageways 16 which can detect air flow bidirectionally and provide output signals indicating a sucking or blowing action for each of the air flow passageways 16.

As shown in FIG. 2, the breath controller unit 10 further includes a lower section 68 having a lower lip sensing transducer 70 on the bottom thereof, as well as thumb controller wheel 24. As in the case of upper lip sensing transducer 20, lower lip sensing transducer 70 may preferably be formed of a force sensing resistor film. An output signal proportional to the lip pressure applied thereto may be provided through printed circuit type conductive leads (not shown) formed directly on lower section 68. Thumb wheel controller 24 preferably has a spring return mechanism, so that the output thereof will be at a normal level setting unless adjusted by the thumb of the performer. The analog output of thumb wheel controller 24 may similarly be provided along conductive traces (not shown) formed directly on bottom section 68. The various conductive leads provided from the sensors and switches in each of top section 52, top sensor plate 54, and bottom section 68, are all provided to one end of the breath controller unit 10 where they couple to data cable 38, for example, through an adapter plug. Alternatively, the leads may be provided to a miniature RF transmitter which broadcasts the sensor output signals to a receiver in the electronic control unit 12 to allow greater freedom of flexibility for movement of the performer.

It will be appreciated that the specific sandwich structure and air flow sensor layout illustrated in FIG. 2 may be varied while maintaining the advantageous features of the breath controller unit 10. For example, the upper sections 52, 54 and bottom sections 64, 68 may be combined into a single plate to result in a three part sandwich structure instead of a five part structure as illustrated. Furthermore, the manner in which various plates are mounted together may be chosen to provide ease of disassembly for cleaning the unit or replacing sensor units, or may be integrally bonded through adhesive or other bonding techniques to form a solid structure. Other variations in the manner of construction of the breath controller unit 10 may also be made, as will be appreciated by those of skill in the art.

Figure 3:
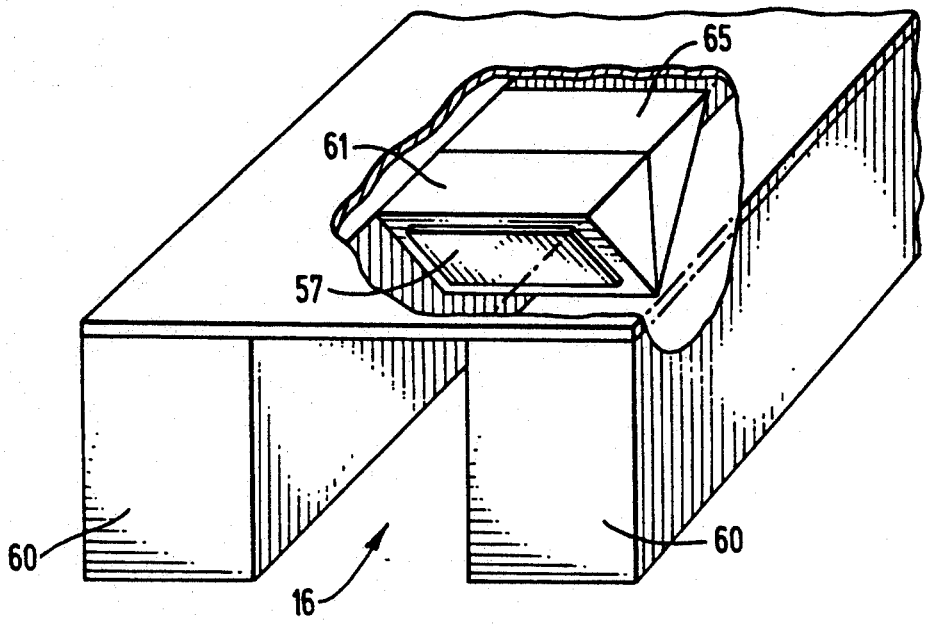
FIG. 3(*a*) is a broken away perspective view through an air flow passageway in the breath controller unit of the present invention.
Figure 3:
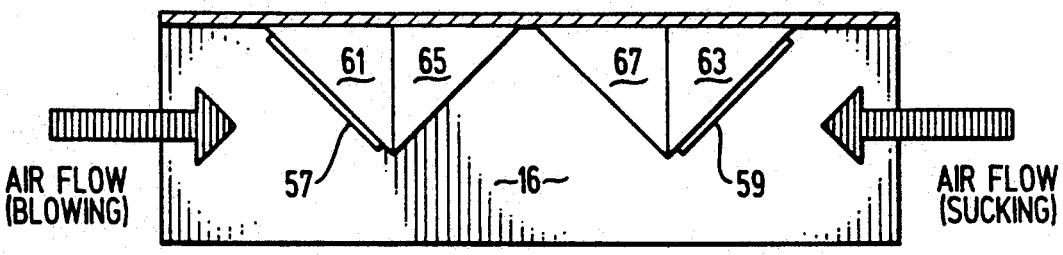

Referring to FIGS. 3(*a*) and 3(*b*), a preferred embodiment of the directional air flow sensors 56, 66 is illustrated FIG. 3(*a*) is a broken away perspective view through an air flow passageway 16 in breath controller unit 10 and FIG. 3(*b*) is a cross-sectional view thereof. To enable bidirectional air flow detection, first and second solid state air flow sensors 57, 59, respectively, are provided in each air flow passageway 16. First solid state air flow sensor 57 is mounted on a first wedge shaped baffle 61 to orient the air flow sensor 57 so as to expose the surface thereof directly to air flow during a blowing action (i.e., air flow from left to right through passageway 16 as in FIG. 3(*b*)). The second solid state air flow sensor 59 in turn is mounted on a second wedge shaped baffle 63, to orient airflow sensor 59 toward the direction of air flow during a sucking action (i.e., air flow from right to left as in FIG. 3(*a*)). In a preferred embodiment, air flow sensors 57, 59 are of a design such as described in detail in the Henderson, et al. article, having a Wheatstone bridge arrangement which senses changes in the resistance on the legs of the Wheatstone bridge due to differential air flow. Thus sensors 57, 59 can detect the magnitude of the air flow with the direction of air flow being determined by comparing the sensor outputs and determining the sensor which detects the greatest amount of air flow. Since solid state sensors 57, 59 are manufactured using integrated circuit technology they may be very small and do not place any significant restriction on the size of air flow passageways 16. Optional baffles 65, 67 may be provided which reduce turbulence introduced in the air flow past first and second baffles 61, 63 due to the venturi effect resulting from the restricted air flow region below baffles 61, 63. These baffles 65, 67 will thus reduce the likelihood of directional magnitude errors during vigorous blowing or sucking actions. Also, as will be appreciated from FIGS. 3(*a*) and 3(*b*), the air flow sensors 57, 59 are mounted on top of air flow passageways 16 so that the influence of any saliva on the function of the sensors may be minimized.

Figure 4:
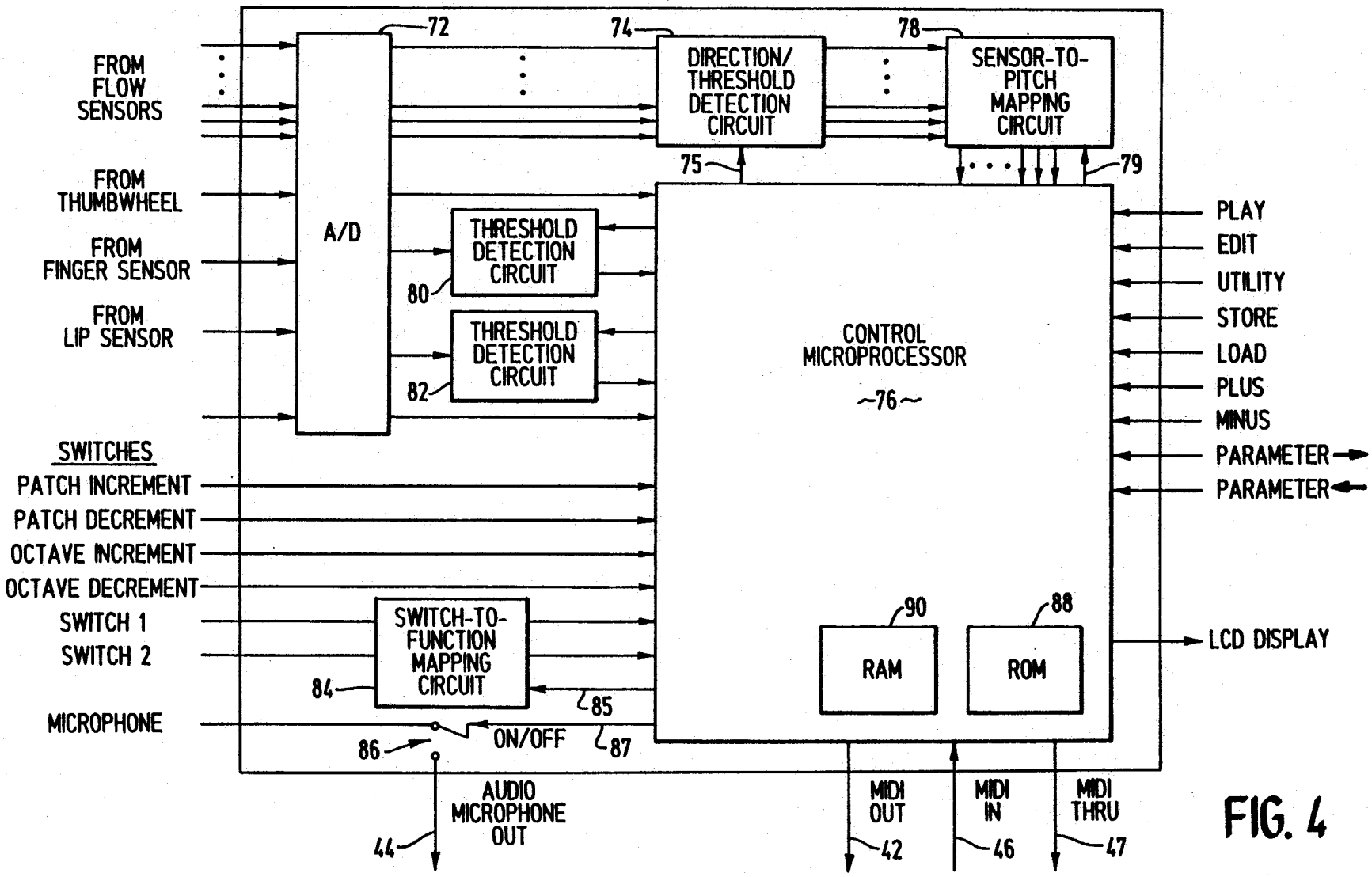
FIG. 4 is a block schematic diagram illustrating the control electronics in the electronics unit of the present invention.

Referring to FIG. 4, the electronics circuitry employed in electronics control unit 12 is illustrated in block schematic form. As shown in FIG. 4, the analog outputs from the airflow sensors 56, 66 thumb wheel controller 24, upper and lower lip pressure sensors 20, 70, and finger pressure sensor 22 are provided to an analog-to-digital converter 72. Analog-to-digital converter 72 provides digital output signals corresponding to the analog inputs from the aforementioned sensors and control transducer. Digital output signals corresponding to the air flow sensor signals are provided to a direction/threshold detection circuit 74 which compares air flow magnitudes from pairs of sensors 56, 66 to determine air flow direction and also detects whether the air flow through the passageway 16 reaches a threshold level sufficient to provide a Note On signal. As illustrated, the direction/threshold detection circuit 74 also receives a control signal on line 75 from the control microprocessor 76. As will be discussed in more detail below, control microprocessor 76 allows the level of the threshold to be adjusted by the user of the electronic musical instrument. Direction/threshold detection circuit 74 provides output signals, corresponding to the digital magnitude of those air flow sensor signals which exceed the threshold determined by control microprocessor 76, to sensor-to-pitch mapping circuit 78. As will be described in more detail below, sensor-to-pitch mapping circuit 78 assigns a tone pitch to each air flow sensor; i.e., a tone pitch for each blowing or sucking action for each air flow passageway 16 in breath controller 10.

As further indicated in FIG. 4, sensor-to-pitch mapping circuit 78 receives input signals on line 79 from control microprocessor 76 to control reassignment of the air flow sensor-to-pitch mapping based upon instructions from the user of the electronic musical instrument.

The input signals from thumb wheel controller 24, finger pressure sensor 22, and lip pressure sensors 20, 70, provided to analog-to-digital converter 72, are also provided to the control microprocessor 76 after analog to digital conversion. The input signals from the finger pressure sensor 22 and lip sensors 20, 70 are first provided to threshold detection circuits 80 and 82 so that a tone control signal from the finger pressure sensor 22 or lip pressure sensors 20, 70 are not provided until the threshold value is reached by the output signal. This allows the performer to hold the unit without activating the sensors until it is much more aggressively squeezed or bit by the performer. These threshold detection circuits 80, 82 also receive an input from the control microprocessor 76 which can be used to adjust the respective thresholds.

As further illustrated in FIG. 4, the input signals from switches 26–36 on the breath controller unit 10 are also provided to the microprocessor 76. In a preferred embodiment, several of the switches may be given preassigned fixed functions, while the remaining switches are left undefined for the user to set their function. As illustrated in FIG. 4, one such assignment is for four of the switches to be allocated to predetermined functions, while two of the switches are left undefined. For example, as illustrated, patch increment, patch decrement, octave increment and octave decrement, which functions will be described in more detail below, are predefined for four of the switches 26–36. As illustrated, the outputs of the four defined function switches are provided directly to control microprocessor 76. The outputs of the undefined switches are provided to a switch-to-function mapping circuit 84 which in turn receives a control signal on line 85 from the control microprocessor 76 to set the function of these switches as determined by the user of the electronic musical instrument.

As shown in FIG. 4, the analog signal provided from microphone 18 on breath controller unit 10 may be simply provided to an on/off switch 86. On/off switch 86 is controlled by a control signal on line 87 from microprocessor 76. When switch 86 is ON, the microphone output signal is provided as an output 44 which is designed to be connected to an audio preamplifier for mixing with the tone generator signal, in audio generation subsystem 14.

As further illustrated in FIG. 4, control microprocessor 76 also receives a number of control signals provided from the user interface panel 40 on the electronics unit 12. As will be described in more detail below, these user interface signals from the control panel 40 allow the control microprocessor 76 to provide a wide variety of output tones and effects in response to the signals provided from the various sensors and switches on the breath controller unit 10, all under the control of the user. For example, as illustrated in FIG. 4, the inputs from the control panel 40 may include control inputs for PLAY, EDIT, UTILITY, STORE, LOAD, PARAMETER PLUS, PARAMETER MINUS, PARAMETER LEFT and PARAMETER RIGHT.

As further illustrated schematically in FIG. 4, control microprocessor 76 will have a permanent read only memory (ROM) storage 88 as well as a rewritable random access memory (RAM) 90. The permanent storage memory 88 will include control programs for the microprocessor 76, as well as prestored fixed assignments between the thumb wheel controller 24, finger sensor 22 and lip pressure sensors 20, 70 as well as switches 26–36. Additionally, ROM 88 may include predetermined sensor-to-pitch mapping assignments which are provided to sensor-to-pitch mapping circuit 78; alternatively, sensor-to-pitch mapping circuit 78 may include a separate ROM which incorporates such prestored assignments. RAM 90 will include the working memory of the control microprocessor 76, as well as storage for the specific sensor assignments set by the user through control panel 40.

The output of microprocessor 76 provided on line 42 is a MIDI (Musical Instrument Digital Interface) digital control signal including the standardized MIDI messages such as set out in the standardized MIDI 1.0 specification, the disclosure of which is incorporated herein by reference. Additionally, the control microprocessor 76 may respond to MIDI input messages provided from audio generation subsystem 14 along line 46. Furthermore, MIDI "through" messages may be provided along line 47 if the control unit 12 is passively linked to other MIDI control systems.

As discussed above, and as shown in FIG. 1, the control unit 12 includes a user interface panel 40 for interacting with control microprocessor 76. Interface panel 40 may preferably employ a set of momentary push buttons, which may be used to set the five modes shown as inputs to control microprocessor 76: PLAY, EDIT, UTILITY, STORE, and LOAD. Each mode button preferably has an LED above it to indicate which of the five modes is presently selected. Within each mode, the user can select different parameters by using the PARAMETER LEFT (←) and PARAMETER RIGHT (→) buttons to cycle through all possible parameters of each mode. Once a parameter has been selected, the user can modify the value of the parameter by using the PARAMETER PLUS and PARAMETER MINUS keys. Feedback is provided by way of the LCD panel 48 which displays alphanumeric information about the current parameter and value.

The following is a description of the functions of the five modes: PLAY, EDIT, UTILITY, STORE and LOAD in one preferred embodiment.

PLAY MODE

PLAY MODE is selected in order to use the breath controller unit 10 to control audio generation subsystem 14 to generate a musical performance. The PLAY MODE will preferably be the default mode which electronics unit 12 is in when it is powered on. There are no parameters to select in the PLAY MODE, and the PARAMETER LEFT, PARAMETER RIGHT, PA- RAMETER PLUS and PARAMETER MINUS keys are not active during PLAY MODE. During PLAY MODE, the sensor signals from electronics breath controller unit 10 are received by electronics unit 12 which outputs MIDI messages according to the current settings of the EDIT PARAMETERS, to be described below.

EDIT MODE

When EDIT MODE is selected, the user can cycle through a large number of parameters by using the PARAMETER LEFT (←) and PARAMETER RIGHT (→) keys. The list of EDIT PARAMETERS includes, but is not limited to the following:

| | |
|---|---|
| Sensor-to-Pitch Mapping (which note is assigned to each air flow sensor) | |
| Parameters: | Recall Prestored Pitch Map Table, Recall User Defined Pitch Map Table, Define Pitch Map Table, Store Pitch Map |
| Inhale Threshold Minimum | |
| Parameter Range: | 0–100 (soft to hard) |
| Inhale Threshold Maximum | |
| Parameter Range: | 0–100 (soft to hard) |
| Inhale Note Velocity Minimum | |
| Parameter Range: | 0–127 |
| Inhale Note Velocity Maximum | |
| Parameter Range: | 0–127 |
| Exhale Threshold Minimum | |
| Parameter Range: | 0–100 (soft to hard) |
| Exhale Threshold Maximum | |
| Parameter Range: | 0–100 (soft to hard) |
| Exhale Note Velocity Minimum | |
| Parameter Range: | 0–127 |
| Exhale Note Velocity Maximum | |
| Parameter Range: | 0–127 |
| Lip Sensor Threshold | |
| Parameter Range: | off, 0–100 (soft to hard) |
| Finger Sensor Threshold | |
| Parameter Range: | off, 0–100 (soft to hard) |
| Lip Sensor (MIDI Message) | |
| Parameter: | user may select one of: Controller 0 . . . 63, Pitch Bend, Key Pressure, Aftertouch |
| Lip Sensor Output Minimum | |
| Parameter Range: | 0–127 |
| Lip Sensor Output Maximum | |
| Parameter Range: | 0–127 |
| Finger Sensor MIDI Message | |
| Parameter: | user may select one of: Controller 0 . . . 63, Pitch Bend, Key Pressure, Aftertouch |
| Finger Sensor Output Minimum | |
| Parameter Range: | 0–127 |
| Finger Sensor Output Maximum | |
| Parameter Range: | 0–127 |
| Microphone State | |
| Parameter: | On, Off |
| User-defined Switch 1 (MIDI Message) | |
| Parameter: | user may select one of: Increment Program Change, Decrement Program Change, Controller 64 . . . 95, Mono Mode, Poly Mode, Lip Sensor On/Off, Finger Sensor On/Off, Microphone On/Off |
| User-defined Switch 2 (MIDI Message) | |
| Parameter: | user may select one of: Increment Program Change, Decrement Program Change, Controller 64 . . . 95, Mono Mode, Poly Mode, Lip Sensor On/Off, Finger Sensor On/Off, Microphone On/Off |

UTILITY MODE

UTILITY MODE is selected to control various parameters not directly related to the behavior of the breath controller unit 10. The parameters available in the UTILITY MODE include, but are not limited to:

| | |
|---|---|
| MIDI Receive Channel | |
| Parameter Range: | 1–16 |
| MIDI Transmit Channel | |
| Parameter Range: | 1–16 |
| MIDI Bulk Store | |
| MIDI Bulk Load | |

STORE MODE

STORE MODE is used to save the current state of all parameters relating to the breath controlled electronic musical instrument into an internal RAM memory 90. The parameters stored in RAM 90 may be recalled using the LOAD MODE (discussed below). In this way, the user can save settings for different songs, etc., and be able to instantly recall them. Since there are a large number of parameters to change, RAM 90 preferably includes a large number of internal memory parameter locations; e.g., 100–200.

LOAD MODE

LOAD MODE is used to recall a previously saved set of parameter settings. For example, this would allow the user to recall a setup for playing in the key of G, with the lip sensor mapped to pitch bend and the finger sensor mapped to modulation, with the microphone turned On.

Figure 5:
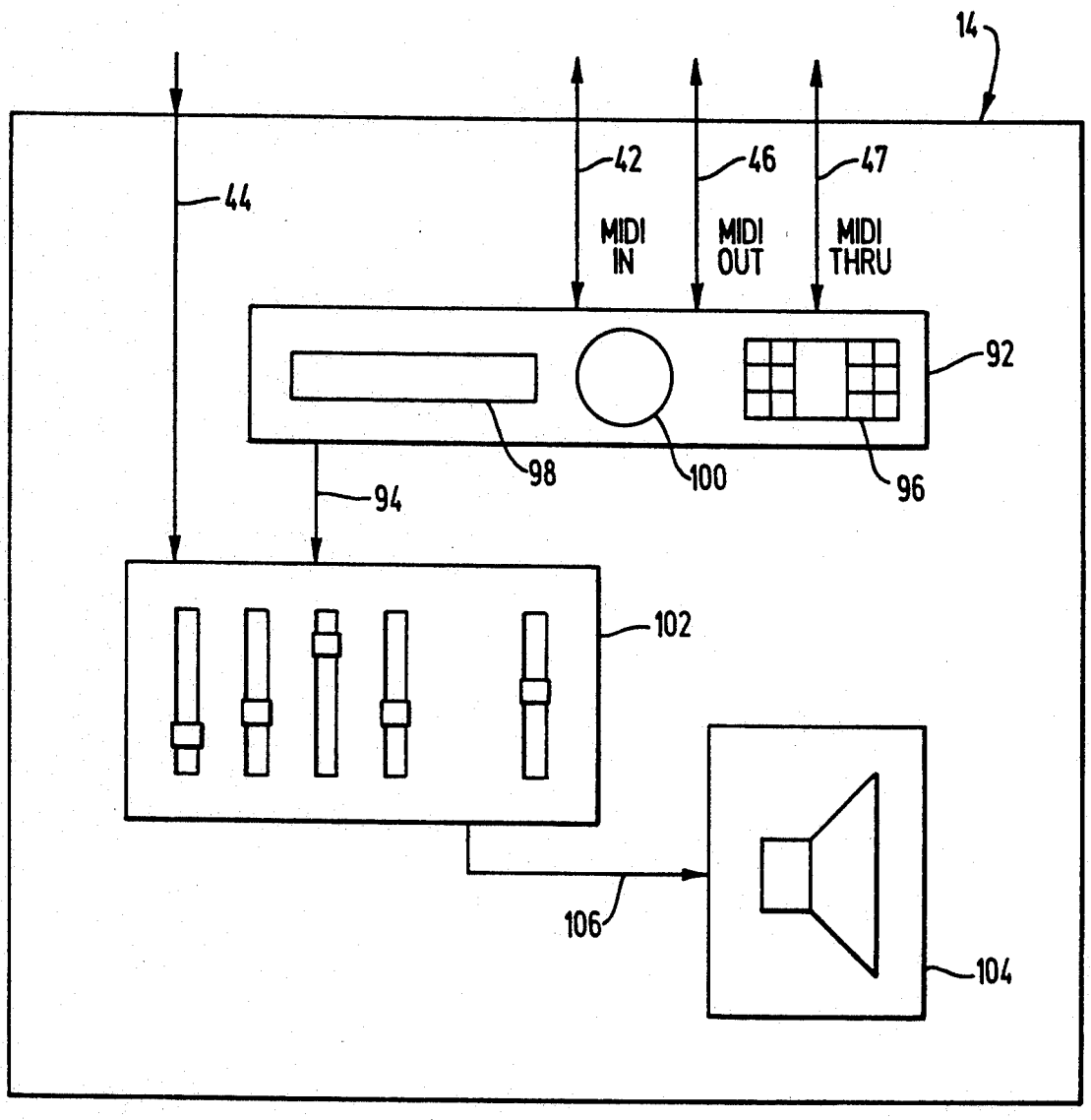
FIG. 5 is a block schematic diagram illustrating the audio generation subsystem of the breath controlled musical instrument of the present invention.

Referring to FIG. 5, an example of audio generation subsystem 14 is illustrated. Audio generation subsystem 14 preferably includes a MIDI synthesizer unit 92 which receives the digital MIDI input tone control signals along line 42 from the electronics unit 12, and in accordance with the MIDI control conventions provides an analog output signal on line 94. Since the MIDI digital control signals are standardized by the MIDI 1.0 specification, MIDI synthesizer unit 92 may be conventional in nature and suitable units are commercially available from a number of musical instrument manufacturers. A typical MIDI synthesizer unit 92 will include a control panel 96, a function display 98, and a volume control 100. Various levels of complexity are possible in such MIDI synthesizer units 92 and in addition to basic tone generation in response to MIDI note and velocity messages may provide a variety of digital effects such as pitch bend, reverberation, etc, activated by the predetermined MIDI digital control message, as well as a number of other digital effects set out in the MIDI 1.0 detailed specification.

Also as illustrated in FIG. 5, the MIDI synthesizer unit 92 may provide output MIDI signals along line 46 to the electronics control unit 12 in response to the MIDI output messages inputted by the user on the control panel 96. For example, line 46 may output a status message to electronics control unit 12 along with various other information on the mode on which the synthesizer unit 92 is set. Additionally, MIDI "through" messages may be provided to and from the electronics control unit along line 47. This line may be used to link plural MIDI synthesizer units together, for example, one synthesizer unit providing basic tone generation signals and another used for more complex digital effects. In principle, a large number of such MIDI synthesizer units 92 could be linked together via the MIDI through line 47, however, only one is illustrated in FIG. 4 for convenience of illustration.

The analog audio out signal provided along line 94 is adapted to be a conventional audio output signal such as may be suitably amplified and generated by conventional audio equipment. In FIG. 5, the analog audio output signal on line 94 is shown provided to an audio mixing preamplifier 102 which may be a conventionally commercially available unit. The mixing preamplifier 102 is also shown receiving the analog microphone audio signal along line 44 which is provided in analog form directly from the electronics control unit 12. The audio signal from the mixing preamplifier 102 is in turn provided to speaker 104 along line 106. Speaker 104 may also be of a conventional commercially available type and may include an amplification stage incorporated therein or in a separate unit (not shown).

It will, of course, be appreciated by those of skill in the art that a wide variety of tone generation layouts are possible utilizing conventional units in various configurations adapted to provide the tone generation effects capable of being provided by the breath controlled electronic musical instrument of the present invention.

It will be readily appreciated that the breath controlled electronic musical instrument of the present invention may be used in a number of ways. For example, via the front panel 40 of electronics unit 12, the EDIT MODE may be selected by the user. It is then possible to map each of the air flow sensors of breath controller unit 10 to any desired musical pitch. For example, for a controller unit with ten air flow passageways, each air flow passageway has two possible pitches, one for inhalation and one for exhalation. An example of a table of hole-to-pitch mappings, called a Pitch Map Table, is illustrated in Table 1.

TABLE 1

| Hole | inhale/ exhale | Pitch (numbers refer to the octave, e.g., C3 = middle C) |
|---|---|---|
| 1 | exhale | C2 |
| | inhale | D2 |
| 2 | exhale | E2 |
| | inhale | F2 |
| 3 | exhale | G2 |
| | inhale | B2 |
| 4 | exhale | C3 |
| | inhale | D3 |
| 5 | exhale | E3 |
| | inhale | F3 |
| 6 | exhale | G3 |
| | inhale | A3 |
| 7 | exhale | C4 |
| | inhale | B3 |
| 8 | exhale | E4 |
| | inhale | D4 |
| 9 | exhale | G4 |
| | inhale | F4 |
| 10 | exhale | C5 |
| | inhale | A4 |

The mapping illustrated in Table 1 is a C major scale. For a D major scale, two halfsteps are added to each of the pitches listed in Table 1. Pitch Map Tables can also be specified by giving the Scale Type. A number of such hole-to-pitch mappings such as illustrated in Table 1 are preferably prestored in ROM 88 of control microprocessor 76 in electronics unit 12. For example, previously defined major, minor, minor 7th and other commonly used scales may be prestored. The user could, for example, select A-minor as the Pitch Map Table without having to define each individual hole-to-pitch assignment by selecting EDIT Parameter Recall Prestored Pitch Map Table and adjusting PARAMETER→or PARAMETER←to obtain the A-minor scale. The individual hole-to-note assignment in turn allows customized scales defined by the user which are not standardized.

The performer can also map any air flow sensor hole to any note and save the mapping of the ten holes into a "patch" inside the electronics unit via the STORE mode. This allows the performer to have access to different scales, including, but not limited to, major, minor, augmented, etc. during a performance using controls on electronics unit 12 or breath controller unit 10. The predefined momentary switches PATCH INCREMENT and DECREMENT can be used to call a different note patch, such that as the performer is playing a certain song, the scales played by the ten holes will change according to the patch selected. This offers a great advantage over the harmonica, which is fixed in its assignment of holes to notes.

Also, as will be readily appreciated, the performer can blow or suck into more than one breath sensor hole at a time, thus creating a chord. The types of chords created can be changed by using the PATCH INCREMENT and DECREMENT switches to select new note patches.

The front panel of electronics control unit 12 also allows the user to select how much air pressure is needed to be considered a valid note. This threshold value may be set at different levels for inhalation and exhalation, but is set the same for each air flow passageway. Since the magnitude of air flow from the air flow sensors is used by the control microprocessor 76 to give the note velocity, in a MIDI message format, it is also possible for the user to specify a maximum air flow threshold. The minimum air flow threshold would correspond to a note velocity of 1 and the maximum air flow threshold would correspond to a note velocity of 127. These numbers correspond to the minimum and maximum velocity values as per the MIDI 1.0 spec. It is also possible to limit the minimum and maximum note velocity values such that the range of note velocity values is somewhere within the range 0–127.

The lip sensors 20, 70 may be advantageously used to control a MIDI pitch bend message. In this case, biting hard on the lip sensors 20, 70 in breath controller unit 10 would cause a decrease or increase in pitch.

The finger sensors 22 may preferably be used to control MIDI modulation messages. In this case, harder finger pressure would provide more of a low-frequency oscillation, corresponding to a vibrato effect.

In a similar manner to the air flow sensors, the finger pressure sensor and lip pressure sensors also have a minimum and maximum threshold value set by the user through electronics unit 12. The user also would have the ability to limit the output value of the sensor control signals to any range within the 0–127 maximum range. In this way, the user can select how sensitive the instrument is to his/her touch, and how much this touch will affect the MIDI message output.

The thumb wheel controller 24 may preferably be used to control the microphone volume, such that the performer could hum or sing or harmonize into the breath controller unit 10 and mix the vocal signal with the synthesizer signal. Thumb wheel controller 24 preferably has a center detent with a spring return mechanism (not shown) so that it will return to the center position when untouched. Its range may be set to anywhere within the MIDI 0–127 range, with the center position defaulted to 64. The center value will, however, preferably be allocated as half of the defined range, for example, a center value 10 for a range of 1 to 20.

As discussed above, four of the switches 26–36 are preferably pre-defined to be: PATCH INCREMENT, PATCH DECREMENT, OCTAVE INCREMENT, and OCTAVE DECREMENT. The octave increment and decrement switches are used to alter the current Pitch Map Table by adding (or subtracting) 12 half-steps (1 octave) to the pitch values listed for each air flow passageway. The patch increment and decrement switches in turn will increment or decrement the current patch number and automatically load the new patch selected. A patch consists of the complete state of all of the user-editable variables, such as Pitch Map Table, Flow Threshold detect values, Microphone on/-off, Finger Pressure on/off, Lip Pressure on/off, Program Change (to select a different patch on a remote tone generator), or any of the MIDI switch controller messages (e.g., controller #64–95, etc.).

Although the above-noted allocation of the lip pressure sensors, finger pressure sensor and thumb wheel output signals to MIDI control messages may be advantageously employed, other assignments may be made by the user. Just as the hole-to-pitch mapping allows each air flow passageway to create a different MIDI NOTE ON message, each of the lip, finger and thumb wheel sensors can be set to one of several types of MIDI messages. Specifically, each of these sensors can be set to create the following MIDI messages: MIDI continuous controller message 0–63, pitch bend, polyphonic key pressure, channel pressure (aftertouch). Any of the 63 continuous controller messages can be selected—some of these have pre-defined meanings, such as volume, modulation, pan, etc. as set out in the MIDI 1.0 specification.

It will be appreciated from the foregoing that the present invention provides a compact but extremely versatile breath controlled polyphonic electronic musical instrument capable of simulating an acoustic harmonica while providing the capability for a wide variety of tone generation effects not provided by an acoustic harmonica. Also, due to the familiarity of many people with the layout of a conventional acoustic harmonica, the breath controller and electronics control unit of the present invention may be used to provide an easy control system for learning generation of musical tones for generating a wide variety of musical voices other than a harmonica.

It should be appreciated that the foregoing description is of a preferred embodiment only and is not limiting as to the various ways the present invention may be configured and the various modes of operation which are possible while remaining within the scope of the present invention.

What is claimed is:

1. A breath controlled electronic musical instrument, comprising:

a breath sensor unit, the unit having a plurality of passageways configured to allow bidirectional air flow therethrough in response to a sucking or blowing action by a performer;

a plurality of air flow sensors, at least one air flow sensor being configured in each passageway in the breath sensor unit, for providing an air flow signal relating to the magnitude and direction of air flow past each sensor;

tone control means, coupled to said flow sensors, for providing a tone control signal derived from said air flow signals, said tone control signal including tone pitch information, said tone control means including means for assigning specific air flow sensors to specific tone pitches, means for storing a plurality of different air flow sensor to tone pitch assignments and means for selecting one of the stored tone pitch/air flow sensor assignments; and tone generator means, coupled to said tone control means, for generating a musical tone in response to said tone control signal.

2. A breath controlled electronic musical instrument as set out in claim 1, wherein said breath sensor unit further comprises a plurality of switches, and wherein said tone control means further comprises means for assigning one or more the switches to specific tone control signals and means for changing the switch/tone control signal assignment.

3. A breath controlled electronic musical instrument as set out in claim 1, wherein said tone control signal is a digital MIDI format signal.

4. A breath controlled electronic musical instrument as set out in claim 1, wherein two air flow sensors are provided in each passageway, the first one of said air flow sensors providing a first air flow signal in response to air flow through said passageway in a first direction corresponding to a blowing action by said performer and a second of said air flow sensors providing a second air flow signal in response to air flow in a second direction, corresponding to a sucking action by said performer.

5. A breath controlled electronic musical instrument as set out in claim 1, further comprising threshold detection means, electrically coupled to said air flow sensors, for receiving said air flow signals from said sensors and comparing the magnitude thereof to a threshold value and providing an output signal to said tone control means for said air flow signals exceeding said threshold value.

6. A breath controlled electronic musical instrument as set out in claim 5, wherein said threshold detection means includes means for changing said threshold value in response to a signal from said tone control means.

7. A breath controlled electronic musical instrument as set out in claim 1, further comprising a microphone, configured in said breath sensor unit, for detecting sounds made by the performer and providing a microphone output signal corresponding thereto.

8. A breath controlled electronic musical instrument as set out in claim 1, wherein said breath sensor unit further comprises means for sensing the pressure applied by the lips of the performer and providing lip pressure signals corresponding thereto to said tone control means.

9. A breath controlled electronic musical instrument as set out in claim 1, wherein said breath sensor unit further comprises means for sensing the pressure applied by the fingers of at least one hand of the performer while holding the breath sensor unit and providing a finger pressure output signal to said tone control means.

10. A breath controlled electronic musical instrument as set out in claim 1, wherein said tone control means is coupled to said breath sensor unit by a data cable.

11. A breath controlled electronic musical instrument as set out in claim 1, wherein said tone control means is coupled to said breath sensor unit through an RF link.

12. A breath controller unit for controlling an electronic musical tone generator, comprising:

a top section having an elongated generally planar shape;

an upper air flow sensor section having an elongated generally planar shape and having a top major surface and a bottom major surface, the bottom major surface having a plurality of air flow sensors mounted thereon;

a middle air flow sensor section, having a generally comb-like structure with a plurality of air flow openings and a plurality of partitions defining the comb-like structure; and a bottom section having a general planar shape matching that of said top section and having an upper major surface and a lower major surface;

wherein the top section, upper air flow sensor section, middle air flow sensor section, and bottom section are mounted together so as to form an integral unit having a plurality of air flow passages defined by the comb-like structures and the upper air flow sensor section, and wherein said plurality of air flow sensors in said upper air flow sensor section are configured entirely within said passageways and detect air flow through said passageways in first and second directions, corresponding to blowing and sucking actions by a performer, respectively.

13. A breath controller unit as set out in claim 12, wherein said top section has an upper major surface and a lower major surface, said upper major surface having a first pressure sensitive transducer and a second pressure sensitive transducer configured thereon.

14. A breath controller unit as set out in claim 13, wherein said upper major surface further includes a plurality of switches configured thereon.

15. A breath controller unit as set out in claim 12, further comprising a plurality of directional air flow baffles, mounted on said lower surface of said upper air flow sensor section, wherein each air flow sensor is mounted on a directional air flow baffle so that a differing air flow response is provided for a sucking and a blowing air flow direction past the air flow sensor.

16. A breath controller unit as set out in claim 13, wherein the lower major surface of said bottom section has a third pressure sensitive transducer thereon for detecting the pressure applied by the lower lip of a performer blowing or sucking on the breath sensor unit.

17. A breath controller unit as set out in claim 12, wherein said bottom section further comprises a thumb wheel controller means mounted therein for providing a thumb wheel control output signal in response to rotation thereof.

18. A breath controller unit, for controlling an electronic musical synthesizer, comprising:

a housing unit, having a plurality of air flow passageways therein, said passageways having openings at both ends so as to allow two-way air flow therethrough in response to blowing or sucking actions of a performer;

air flow sensor means, positioned in each passageway, for detecting bidirectional air flow through said passageway and providing an air flow signal related to the direction and magnitude of the air flow past said sensor;

pressure sensing means, configured on the outside of said housing unit, for sensing pressure applied thereto by the performer and providing a pressure output signal; and tone control means for receiving said air flow signals and said pressure signal and providing a tone control signal derived therefrom.

19. A breath controller unit as set out in claim 18, wherein said pressure sensing means comprises a first force sensing transducer configured on the housing unit for sensing the force applied by the lips of the performer when blowing or sucking air through the breath controller unit and a second force sensing transducer for sensing the force applied to the housing by the performer's fingers while gripping the breath controller unit.

20. A breath controller unit as set out in claim 19, wherein said first and second force sensing transducers are polymer thick film force sensing resistors.

21. A breath controller unit as set out in claim 18, wherein said air flow sensors are solid state transducers.

22. A breath controller unit as set out in claim 18, further comprising a microphone configured in the housing unit, for providing a microphone signal corresponding to sounds of the performer while playing the breath controller unit.

23. A breath control device, for controlling the tone generation of an electronic musical instrument, comprising:

a hand-held breath sensor unit having a plurality of air flow passageways therein, each air flow passageway having at least one air flow sensor mounted therein, said air flow sensors providing air flow signals proportional to the magnitude and direction of the air flow through said passageways;

a control transducer mounted on the breath sensor unit, for providing one or more control signals in response to activation by a performer;

tone control means, electrically coupled to said breath sensor unit so as to receive said air flow signals and said control signal, comprising:

analog to digital conversion means, for receiving said air flow signals and said control signal and converting them into digital air flow signals and digital control signals, respectively;

tone pitch mapping means for receiving said digital air flow signals and providing a tone pitch signal for each air flow signal and a tone volume control signal related to the magnitude of the air flow signal; and means, coupled to said tone pitch mapping means, for receiving one of said control transducer output signals and providing a tone control signal in response thereto.

24. A breath control device as set out in claim 23, wherein said control transducer is a thumb wheel controller.

25. A breath control device as set out in claim 23, wherein said tone control means further comprises means coupled to said control transducer for varying the tone volume signal in relation to said tone control transducer signal.

26. A breath control device as set out in claim 23, further comprising a plurality of switches, mounted on the breath sensor unit for providing a plurality of switch output signals in response to activation thereof by the performer.

27. A breath control device as set out in claim 23, wherein said control transducer comprises pressure transducer means, mounted on said breath sensor unit, for providing a pressure signal corresponding to pressure applied thereto by the performer.

28. A breath control device as set out in claim 27, wherein said pressure transducer means is a thick film pressure sensing resistor.

29. A breath control device as set out in claim 23, wherein said tone control means further comprises a threshold detection circuit for detecting when said air flow signals exceed a threshold value and providing a NOTE ON signal in response thereto.

30. A breath control device as set out in claim 23, further comprising a microphone configured on said sensor unit, said microphone providing a signal corresponding to detected audio sounds of the performer to the tone control means.

31. A breath control device as set out in claim 23, wherein said control transducer comprises a first force sensing film and a second force sensing film, providing first and second force output signals, respectively, and wherein said tone control means further comprises means for varying said tone pitch signals in response to said second force signals.

32. A breath control device as set out in claim 23, wherein said tone control means further comprises means, controllable by the performer, for assigning specified air flow sensors to a group of notes and storing data corresponding to said sensor to note group assignment.

33. A breath control device as set out in claim 32, further comprising means, mounted on said sensor unit and operable by the performer, for providing a note group change signal and wherein said tone control means further comprises means for changing the assignment of sensors to a group of notes in repsonse to said note group change signal.

34. A breath control device as set out in claim 23, wherein said tone control means further comprises means, responsive to one of said control signals, for providing a pitch change signal and wherein said means for receiving increments the tone pitch of each pitch assigned to each air flow sensor by one octave in response to the pitch change signal.

* * * * *